US007922603B2

(12) United States Patent
Boyd et al.

(10) Patent No.: US 7,922,603 B2
(45) Date of Patent: Apr. 12, 2011

(54) GOLF CLUB ASSEMBLY AND GOLF CLUB HEAD WITH BAR AND WEIGHTED MEMBER

(75) Inventors: Robert Boyd, Euless, TX (US); Donald S. Rahrig, Mansfield, TX (US); Philip J. Hatton, Portland, OR (US); Andrew G. V. Oldknow, Portland, OR (US)

(73) Assignee: Nike, Inc., Beaverton, OR (US)

( * ) Notice: Subject to any disclaimer, the term of this patent is extended or adjusted under 35 U.S.C. 154(b) by 215 days.

(21) Appl. No.: 12/356,176

(22) Filed: Jan. 20, 2009

(65) Prior Publication Data

US 2010/0184532 A1 Jul. 22, 2010

(51) Int. Cl.
*A63B 53/04* (2006.01)
*A63B 53/06* (2006.01)

(52) U.S. Cl. ..... 473/334; 473/340

(58) Field of Classification Search ..... 473/223, 473/226, 251, 256, 313, 324–350
See application file for complete search history.

(56) References Cited

U.S. PATENT DOCUMENTS

| | | | | |
|---|---|---|---|---|
| 3,170,698 | A | 2/1965 | Schoeffler et al. | |
| 3,966,210 | A | 6/1976 | Rozmus | |
| 4,291,883 | A | 9/1981 | Smart et al. | |
| 4,895,371 | A * | 1/1990 | Bushner | 473/336 |
| 5,429,366 | A * | 7/1995 | McCabe | 473/244 |
| 6,015,354 | A * | 1/2000 | Ahn et al. | 473/256 |
| 6,558,271 | B1 * | 5/2003 | Beach et al. | 473/327 |
| 7,163,470 | B2 | 1/2007 | Galloway et al. | |
| 2003/0054900 | A1 | 3/2003 | Tindale | |
| 2005/0137024 | A1 | 6/2005 | Stites et al. | |
| 2007/0225085 | A1 | 9/2007 | Koide et al. | |
| 2008/0146370 | A1 | 6/2008 | Beach et al. | |
| 2008/0171610 | A1 | 7/2008 | Shin | |
| 2009/0186717 | A1 | 7/2009 | Stites et al. | |

FOREIGN PATENT DOCUMENTS

| | | | |
|---|---|---|---|
| GB | 2422554 | A | 8/2006 |
| WO | 2005035073 | A1 | 4/2005 |
| WO | 2005058427 | A1 | 6/2005 |
| WO | 2005079933 | A1 | 9/2005 |

OTHER PUBLICATIONS

International Search Report and Written Opinion issued Jul. 7, 2010 in corresponding PCT Application No. PCT/US2010/021355.
Invitation to Pay Additional Fees and Partial Search Report issued Apr. 12, 2010 in corresponding PCT Application No. PCT/US2010/021355.

* cited by examiner

*Primary Examiner* — Alvin A Hunter
(74) *Attorney, Agent, or Firm* — Banner & Witcoff, Ltd.

(57) ABSTRACT

A golf club head includes a body having a first arm and a second arm extending outwardly therefrom. A bar has a first end connected to a free end of the first arm and a second end connected to a free end of the second arm. A weighted member is positioned along the bar.

29 Claims, 4 Drawing Sheets

GOLF CLUB ASSEMBLY AND GOLF CLUB HEAD WITH BAR AND WEIGHTED MEMBER

FIELD OF THE INVENTION

Aspects of this invention relate generally to golf clubs and golf club heads, and, in particular, to golf clubs and golf club heads having a bar and a weighted member.

BACKGROUND OF THE INVENTION

Golfers tend to be sensitive to the "feel" of a golf club. The "feel" of a golf club comprises the combination of various component parts of the club and various features associated with the club that produce the sensations experienced by the player when a ball is swung at and/or struck. Club weight, weight distribution, swing weight, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, lose his/her grip, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

Each user has a particular swing that includes many factors that impact the path of the ball after impact. For example, club head speed, point of impact on the club face, and launch angle are all variables that help determine the path of the ball. A golf club can be customized for a particular user's swing by selecting the club head components that most closely match the type of swing the user has.

The performance of a golf club can vary based on several factors, including weight distribution about the head, which affects the location of the center of gravity of the golf club head. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, including ball flights that often are referred to as "pulls," "pushes," "draws," "fades," "hooks," or "slices." Similarly, when the center of gravity is spaced above or below the point of engagement, the flight of the golf ball may exhibit more boring or climbing trajectories, respectively.

Altering the moment of inertia can also affect how the golf club performs including how the golf club head design impacts heel and toe mishits. Similarly, other factors such as point of impact and launch angle can also affect how the ball travels once it has been struck.

Accordingly, club heads may be formed with various configurations to provide different performance characteristics and "feels." For example, club heads can be configured to have different weights secured thereto to alter the performance characteristics and "feel" of the club. In other club heads, a component having a characteristic with a particular value, e.g., size or weight, can be replaced with another component having a different value for that characteristic. By varying the body components of a club head, its performance and "feel" can be altered. It would be desirable to provide a golf club head with a bar and weighted member that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to provide a golf club head with a bar and weighted member that can be selectively adjusted by a user. In accordance with a first aspect, a golf club head includes a body having a first arm and a second arm extending outwardly therefrom. A bar has a first end connected to a free end of the first arm and a second end connected to a free end of the second arm. A weighted member is positioned along the bar.

In accordance with another aspect, a golf club head includes a body defining a first arm and a second arm. A sole plate extends between the first arm and the second arm. A bar has a first end connected to a free end of the first arm and a second end connected to a free end of the second arm. A weighted member is movable along the bar.

In accordance with a further aspect, a golf club assembly includes a shaft; and a club head secured to the first end of the shaft. The club head includes a body having a first arm and a second arm extending outwardly therefrom. A bar has a first end connected to a free end of the first arm and a second end connected to a free end of the second arm. A weighted member is positioned along the bar.

Substantial advantage can be achieved by providing a golf club head with a bar and weighted member on the bar. In particular, certain embodiments allow a user to individually customize the mass properties of the head, thereby optimizing the performance of the club head for the user's swing.

These and additional features and advantages disclosed here will be further understood from the following detailed disclosure of certain embodiments.

Figure 1:
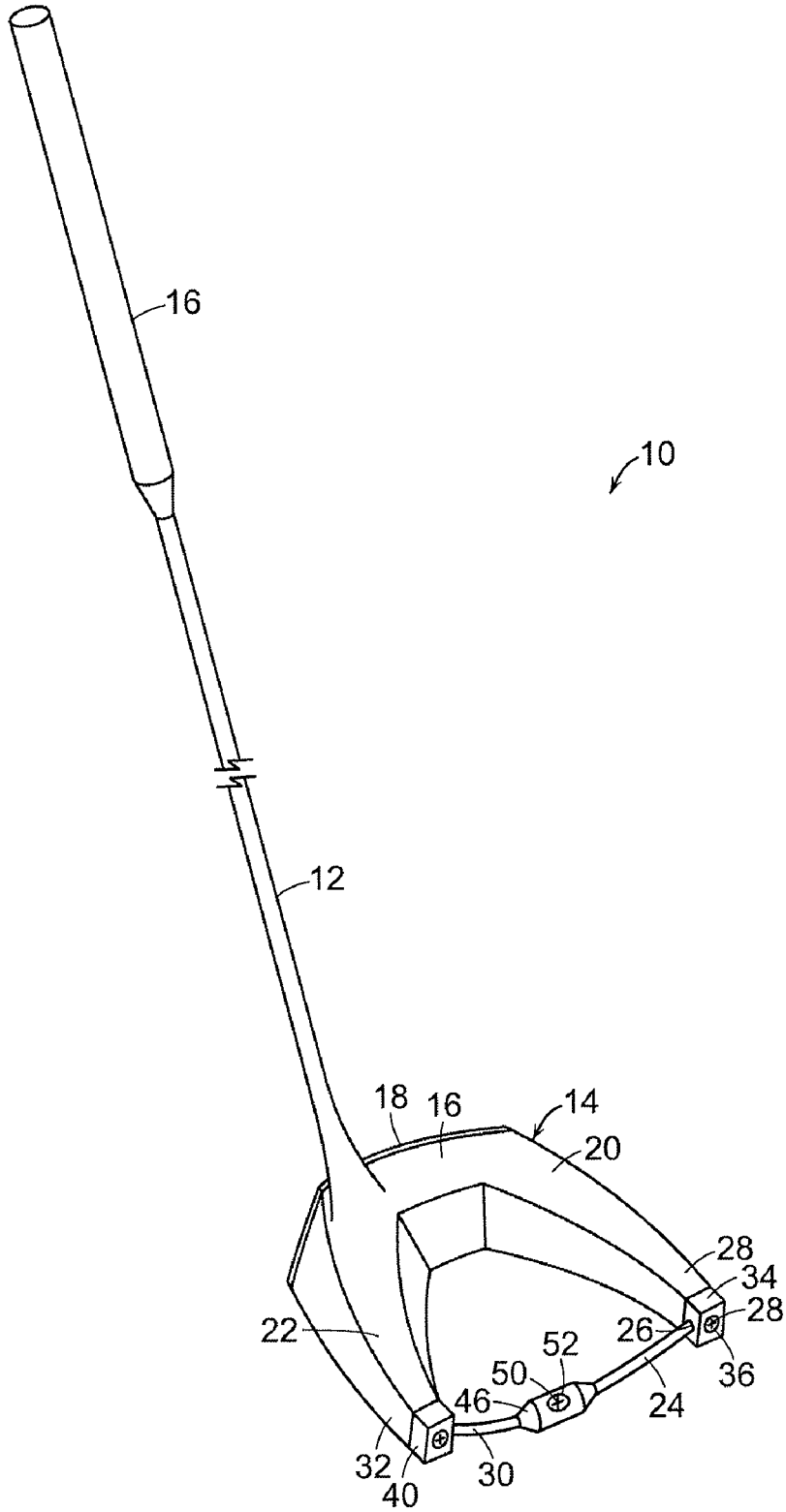
FIG. 1 is a perspective view of a golf club with a bar and weighted member according to an illustrative aspect.

The figures referred to above are not drawn necessarily to scale, should be understood to provide a representation of particular embodiments of the invention, and are merely conceptual in nature and illustrative of the principles involved. Some features of the golf club with a bar and weighted member depicted in the drawings have been enlarged or distorted relative to others to facilitate explanation and understanding. The same reference numbers are used in the drawings for similar or identical components and features shown in various alternative embodiments. Golf clubs with a bar and weighted member as disclosed herein would have configurations and components determined, in part, by the intended application and environment in which they are used.

DETAILED DESCRIPTION OF CERTAIN PREFERRED EMBODIMENTS

An illustrative embodiment of a golf club 10 is shown in FIG. 1 and includes a shaft 12 and a golf club head 14 attached to shaft 12. Golf club head 14 may be any driver, wood, or the like. Shaft 12 of golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, etc.). A grip or other handle element 16 is positioned on shaft 12 to provide a golfer with a slip resistant surface with which to grasp golf club shaft 12. Grip element 16 may be attached to shaft 12 in any desired manner, including in conventional manners known and used in the art (e.g., via adhesives or cements, via threads or other mechanical connectors, via fusing techniques, via friction fits, via retaining element structures, etc.).

Club head 14 includes a plurality of components. As illustrated, this example golf club head 14 includes a body member 16 and a face plate 18 positioned on a front surface of body member 16. A first arm 20 and a second arm 22, spaced from first arm 20, extend rearwardly from body member 16 defining between the arms a space 23 that extends through club head 14. In the illustrated embodiment, body member 16, first arm 20, and second arm 22 cooperate to form a substantially V-shaped club head 14.

A bar 24 has a first end 26 connected to a free end 28 of first arm 20, and a second end 30 connected to a free end 32 of second arm 22 such that bar 24 extends between first arm 20 and second arm 22. In certain embodiments, bar 24 is curved. In the embodiment illustrated in FIG. 1, bar 24 is curved outwardly away from free ends 28 and 32 of first and second arms 20, 22, respectively, in a direction extending away from body member 16 and face plate 18.

In the illustrated embodiment a first mounting member 34 is connected to first end 26 of bar 24. A first aperture 36 extends through first mounting member 34, and a fastener, such as first screw 38 extends through first aperture 36 and secures first mounting member 34 to first arm 20.

Similarly, a second mounting member 40 is connected to second end 30 of bar 24. A second aperture 42 extends through second mounting member 40, and a fastener, such as second screw 44 extends through second aperture 42 and secures second mounting member 40 to second arm 22.

In the illustrated embodiment, bar 24 has a substantially cylindrical cross-section. It is to be appreciated that bar 24 can have another cross-section such as rectangular, triangular, or any other desired cross-section. Bar 24 may be formed of various materials, such as steel, aluminum, titanium, graphite, or composite materials, as well as alloys and/or combinations thereof, including materials that are conventionally known and used in the art.

A weighted member 46 is positioned on and movable along bar 24. Weighted member 46 has a central aperture 48 extending therethrough. In the illustrated embodiment, with bar 24 having a substantially cylindrical cross-section, central aperture 48 is substantially cylindrical. It is to be appreciated that central aperture 48 would have a shape mating with that of the cross-section of bar 24.

In certain embodiments, a fastener such as a set screw 50 extends through an aperture 52 formed in weighted member 46 to secure weighted member 46 to bar 24. Thus, weighted member 46 can be moved to any desired position along bar 24 and secured in that desired position with set screw 50, or any other suitable fastener. By positioning weighted member 46 at different positions along bar 24, the performance of club head can be altered and optimized to accommodate the swing of a particular golfer, and can be changed for a particular golfer as their swing changes over time. By moving weighted member 46, the center of gravity of the club can be altered, provide a club head that is more toe-weighted or heel-weighted, as well as moving the center of gravity closer to or further away from face plate 18.

Weighted member 46 may be formed of various materials, such as steel, aluminum, titanium, graphite, or composite materials, as well as alloys and/or combinations thereof, including materials that are conventionally known and used in the art.

Figure 2:
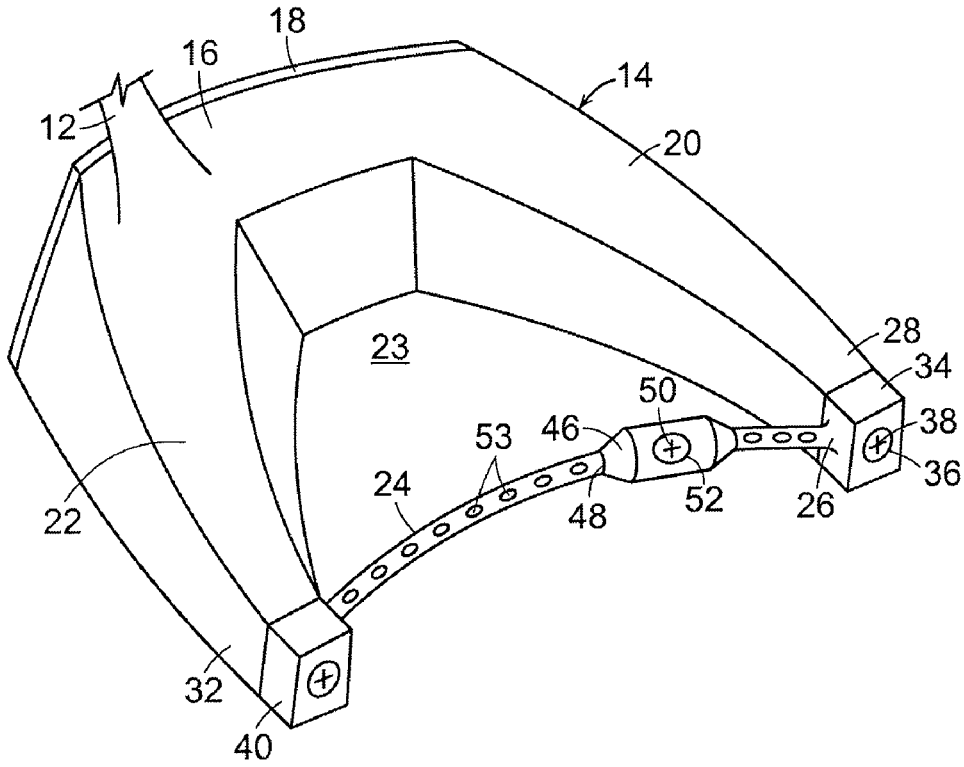
FIG. 2 is a perspective view of an alternative embodiment of the club head of the golf club of FIG. 1.

In certain embodiments, as illustrated in FIG. 2, bar 24 may be curved inwardly toward body member 16 and face plate 18. Additionally, a plurality of recesses 53 may be formed along bar 24, each of which is sized to accommodate set screw 50, thereby providing an improved registration of weighted member with respect to bar 24. Recesses 53 provide a limited number of positions at which weighted member 46 may be secured along bar 24. It is to be appreciated that other fasteners may be used to removably secure weighted member 46 to bar 24, such as pins, fasteners with a ball and mating recesses, or other detent mechanisms. Other suitable fasteners for removably securing weighted member 46 to bar 24 will become readily apparent to those skilled in the art, given the benefit of this disclosure.

Figure 3:
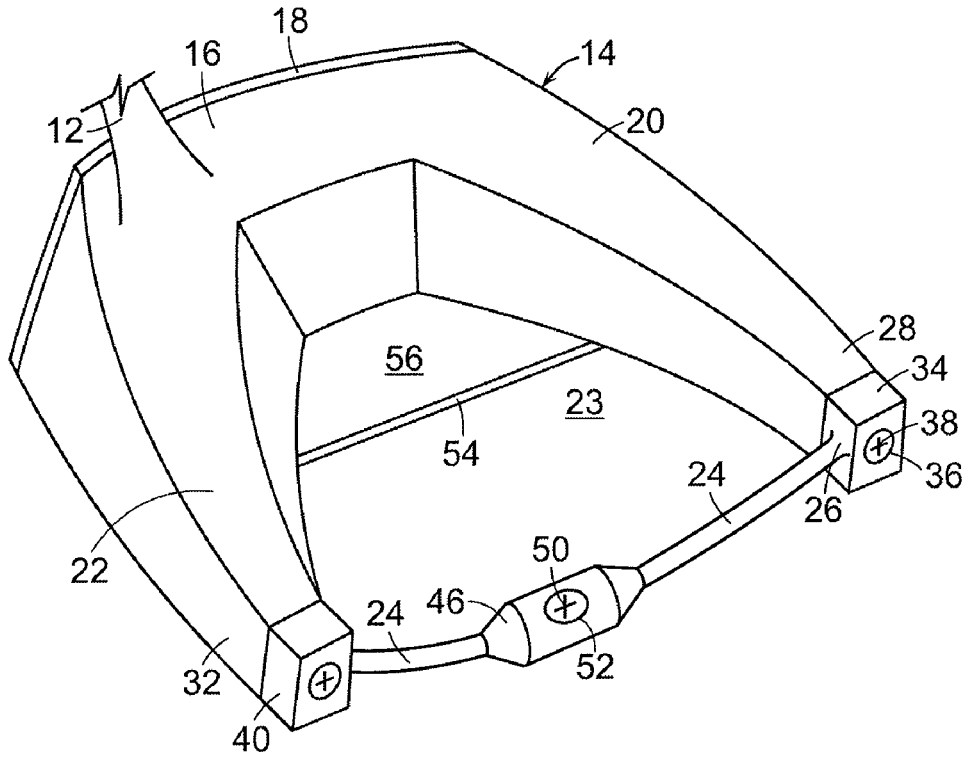
FIG. 3 is a perspective view of another alternative embodiment of the club head of the golf club of FIG. 1, showing a sole plate on a bottom of the club head.

In certain embodiments, as illustrated in FIG. 3, a sole plate 54 may be included in club head 14. Sole plate 54 is secured to a bottom surface of body 16 of club head 14, and extends laterally across club head 14 between first arm 20 and second arm 22. Sole plate 54 may be formed of the same material as body 16 or any other desired material.

Sole plate 54 may extend rearwardly from a front edge of club head 14 along only a portion of first arm 20 and second arm 22. In the illustrated example, sole plate 54 extends rearwardly to approximately a midpoint or central portion of each of first arm 20 and second arm 22. In such an embodiment, an upper surface 56 of sole plate 54 is exposed to an exterior of club head 14 through space 23 formed between first arm 20 and second arm 22. The remainder of space 23 rearwardly of sole plate 54 is unobstructed and provides a clear path vertically through club head 14. The inclusion of sole plate 54 provides a club head for a driver that conforms to the current requirements of the United States Golf Association.

Figure 4:
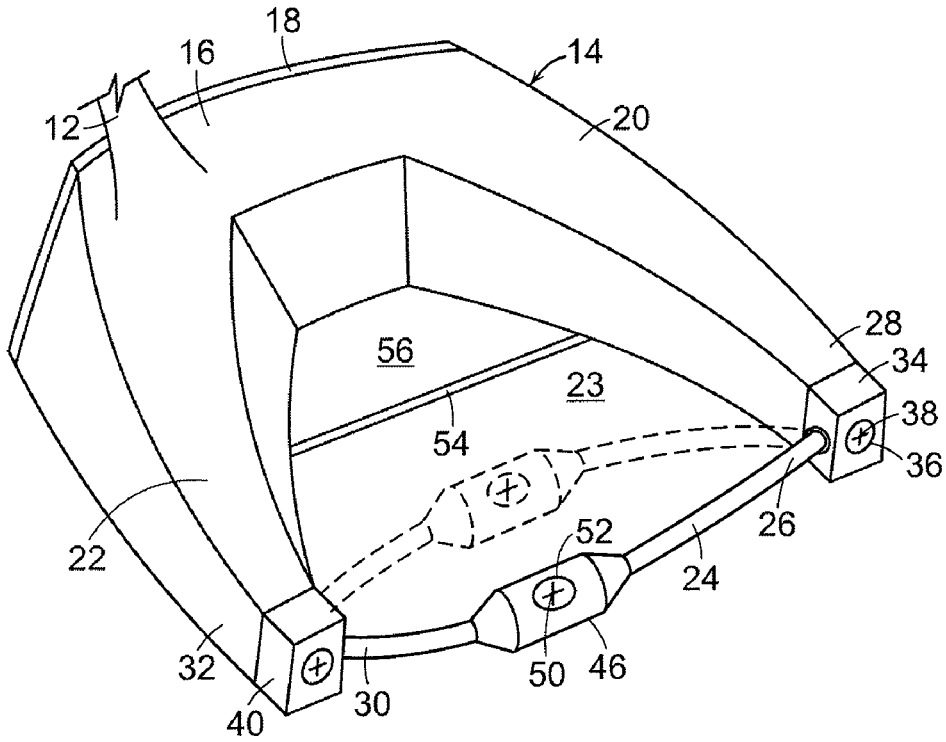
FIG. 4 is a perspective view of yet another alternative embodiment of the club head of the golf club of FIG. 1, showing the bar being pivotable with respect to the head.

Another embodiment is illustrated in FIG. 4 in which bar 24 is pivotable with respect to first arm 20 and second arm 22. In this embodiment, as shown by the solid lines, bar 24 can be pivoted to a point where it curves outwardly away from body 16. Bar 24 can also be pivoted, as shown in dashed lines, such that it curves inwardly toward body 16. In such an embodiment, first end 26 of bar 24 may be pivotally received in a first aperture 58 formed in first mounting member 34, and second end 30 of bar 24 may be pivotally received in a corresponding second aperture (not visible) in second mounting member 40.

In other embodiments, first aperture 58 may be formed directly in free end 28 of first arm 20 and the corresponding second aperture. It is to be appreciated in certain embodiments, bar 24 may be temporarily fixed with respect to body 16 once it has been pivoted to a desired position by a detent mechanism or any other means, and other suitable means will become readily apparent to those skilled in the art, given the benefit of this disclosure. Providing bar 24 with the ability to pivot allows the center of gravity of club head 14 to be moved closer to, or further away from face plate 18.

Figure 5:
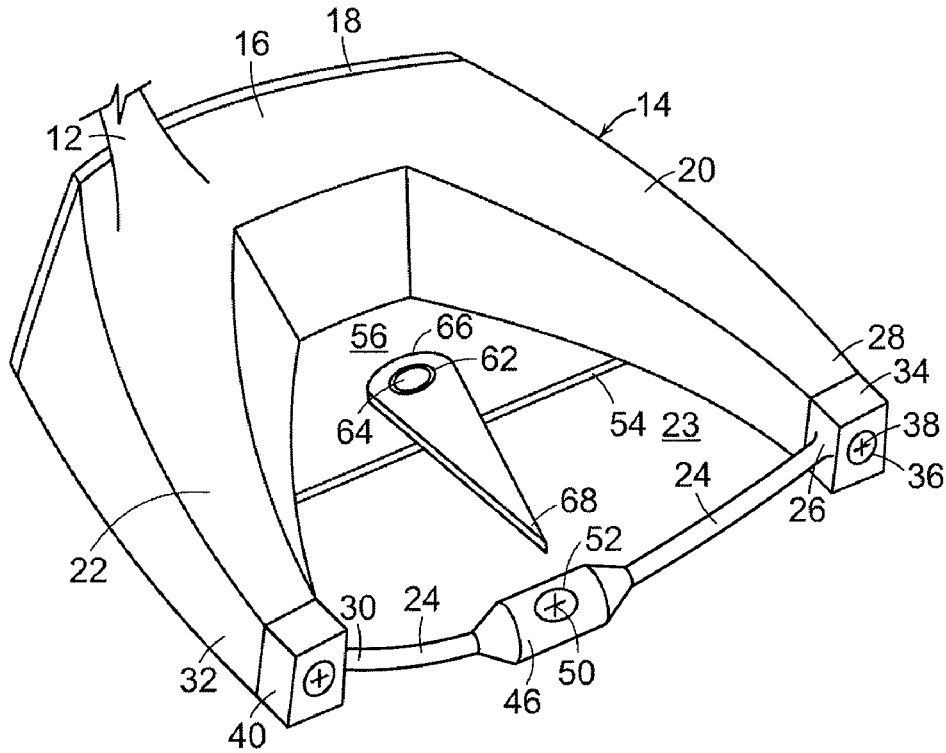
FIG. 5 is a perspective view of a further alternative embodiment of the club head of the golf club of FIG. 1, showing an indicator on a sole plate of the head.

Another embodiment is shown in FIG. 5, in which a movable indicator 60 is located on club head 14. In the illustrated embodiment indicator 60 is positioned on upper surface 56 of sole plate 54. In certain embodiments, an aperture 62 in indicator 60 receives and pivots about a pin or post 64 extending upwardly from upper surface 56 of sole plate 54. Movable indicator 60 can be pivoted by the user to a desired position to assist the user in aligning their golf shot. In the illustrated embodiment in FIG. 5 a first end 66 of indicator 60 is hemispherical in shape and contains aperture 62, with a second end 68 tapering to a point as it extends away from first end 66. It is to be appreciated that indicator 60 can be made of any desired material, and may be formed of the same material as that of body 16, or any other material.

Figure 6:
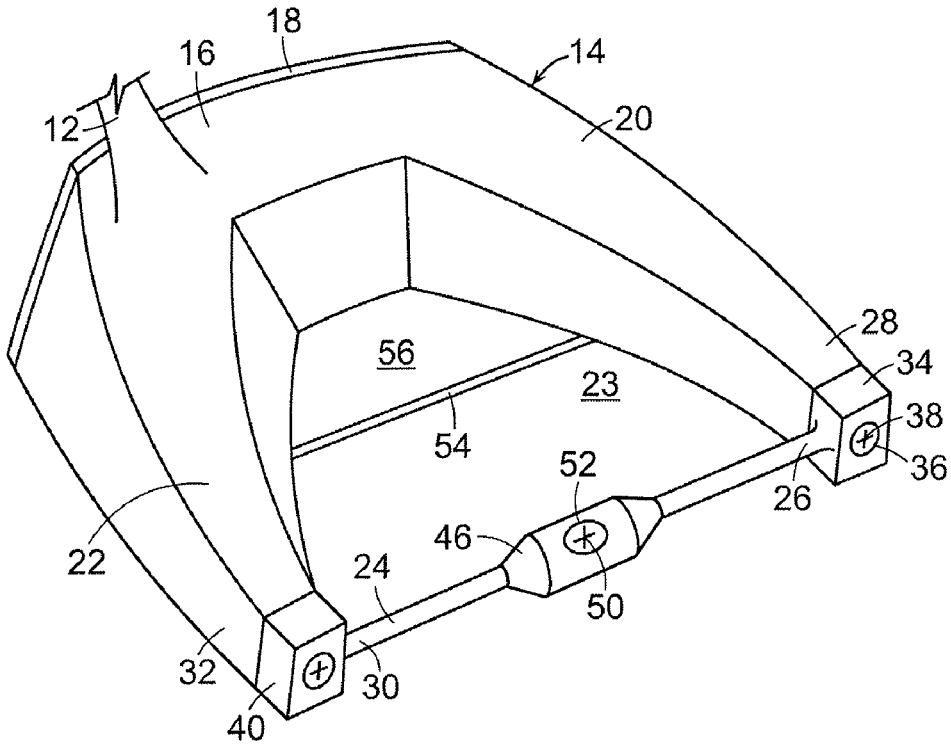
FIG. 6 is a perspective view of yet a further alternative embodiment of the club head of the golf club of FIG. 1, showing a straight bar.

Another embodiment is illustrated in FIG. 6 in which bar 24 extends straight between first arm 20 and second arm 22 rather than being curved between the arms. Such an embodiment allows the center of gravity of club head 14 to be moved laterally along club head 14 between a toe-weighted weighted position and a heel-weighted position, while maintaining the distance between the center of gravity and face plate 18.

Figure 7:
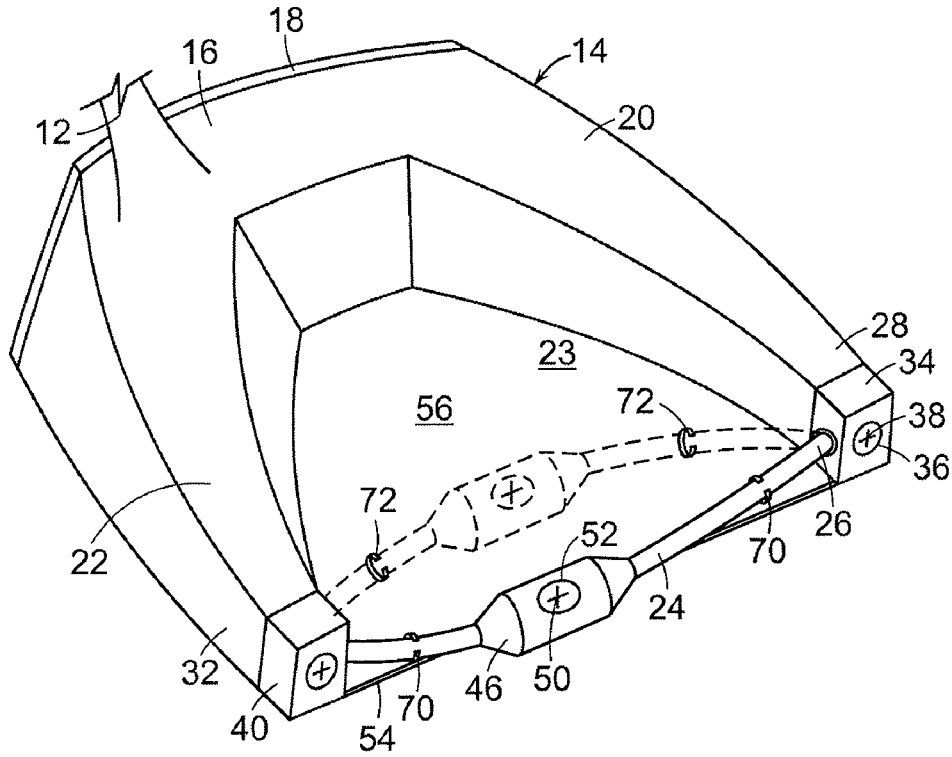
FIG. 7 is a perspective view of yet another alternative embodiment of the club head of the golf club of FIG. 1, showing the bar clipped to a sole plate of the club head.

Yet another embodiment is shown in FIG. 7, in which sole plate 56 extends rearwardly to the free ends 28 and 32 of first arm 20 and second arm 22, respectively. In this embodiment, bar 24 pivots with respect to first arm 20 and second arm 22, and retaining members are used to removably secure bar 24 to sole plate 56. In the illustrated example, a pair of first retaining members 70 in the form of first spring clips 70 are secured to upper surface 56 of sole plate 54, and serve to releasably receive bar 24 when bar 24 is in a forwardly rotated position, thereby releasably securing bar 24 to sole plate 54. A pair of second retaining members 72 in the form of second spring clips 72 are secured to upper surface 56 of sole plate 54, and serve to releasably receive bar 24 when bar 24 is in a rearwardly rotated position, thereby releasably securing bar 24 to sole plate 54. Releasably securing bar 24 to sole plate 54 with first and second retaining members 70, 72 may help enhance the rigidity of club head 14.

As noted above, in the illustrated embodiment a pair of first retaining members 70 and a pair of second retaining members 72 are used to releasably secure bar 24 to sole plate 54. However, it is to be appreciated that in other embodiments, a single first retaining member and single may be used to releasably secure bar 24 to sole plate 54. In yet other embodiments, more than two first retaining members and more than two second retaining members may be used to secure bar 24 to sole plate 54.

Although spring clips are illustrated here for first and second retaining members 70, 72, it is to be appreciated that any suitable retaining member may be used to releasably secure bar 24 to sole plate 54. Other suitable configurations and constructions for retaining members 70, 72 will become readily apparent to those skilled in the art, given the benefit of this disclosure.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head comprising:

a body having a first arm and a second arm extending outwardly therefrom;

a bar having a first end connected to a free end of the first arm and a second end connected to a free end of the second arm, the bar being removably secured to the first and second arms; and a weighted member positioned along the bar.

2. The golf club head of claim 1, wherein the bar is curved.

3. The golf club head of claim 1, wherein the bar is curved outwardly away from the first and second arms.

4. The golf club head of claim 1, wherein the bar is curved inwardly toward the body.

5. The golf club head of claim 1, wherein the bar is straight.

6. The golf club head of claim 1, wherein the weighted member is movable along the bar.

7. The golf club head of claim 1, wherein the weighted member is removably secured to the bar.

8. The golf club head of claim 1, further comprising a fastener securing the weighted member to the bar.

9. The golf club head of claim 8, wherein the fastener is a set screw.

10. The golf club head of claim 1, wherein the bar is pivotable with respect to the first and second arms.

11. The golf club head of claim 1, further comprising a sole plate extending between the first arm and the second arm.

12. The golf club head of claim 11, wherein the first and second arms define a space therebetween, and wherein an upper surface of the sole plate is exposed to an exterior of the body through the space.

13. The golf club head of claim 11, wherein the sole plate extends rearwardly from a front portion of the body to a central portion of each of the first arm and the second arm.

14. The golf club head of claim 11, further comprising a movable indicator on the sole plate.

15. The golf club head of claim 11, further comprising a retaining member on the sole plate to releasably secure the bar to the sole plate.

16. The golf club head of claim 15, wherein the retaining member comprises a spring clip.

17. A golf club head comprising:

a body defining a first arm and a second arm;

a sole plate extending between the first arm and the second arm;

a bar having a first end connected to a free end of the first arm and a second end connected to a free end of the second arm, the bar being removably secured to the first and second arms; and a weighted member movable along the bar.

18. The golf club head of claim 17, further comprising a movable indicator on the sole plate.

19. The golf club head of claim 17, wherein the weighted member is removably secured to the bar.

20. The golf club head of claim 17, further comprising a fastener securing the weighted member to the bar.

21. A golf club assembly comprising:

a shaft; and a club head secured to the first end of the shaft and comprising:

a body having a first arm and a second arm extending outwardly therefrom;

a bar having a first end connected to a free end of the first arm and a second end connected to a free end of the second arm, the bar being removably secured to the first and second arms; and a weighted member positioned along the bar.

22. The golf club assembly of claim 21, wherein the weighted member is movable along the bar.

23. The golf club assembly of claim 21, wherein the weighted member is removably secured to the bar.

24. The golf club assembly of claim 21, further comprising a fastener securing the weighted member to the bar.

25. The golf club assembly of claim 21, wherein the bar is pivotable with respect to the first and second arms.

26. The golf club assembly of claim 21, further comprising a sole plate extending between the first arm and the second arm.

27. The golf club assembly of claim 26, further comprising a movable indicator on the sole plate.

28. The golf club assembly of claim 26, further comprising a retaining member on the sole plate to releasably secure the bar to the sole plate.

29. The golf club assembly of claim 26, wherein the retaining member comprises a spring clip.

* * * * *